US010633853B2

(12) United States Patent
Erlebach

(10) Patent No.: US 10,633,853 B2
(45) Date of Patent: Apr. 28, 2020

(54) SYSTEM AND METHOD FOR RECESSING A SUBFLOOR AND SHOWER STALL WITH A RECESSED SUBFLOOR FLOOR

(71) Applicant: Josef Erlebach, Silverthorne, CO (US)

(72) Inventor: Josef Erlebach, Silverthorne, CO (US)

( * ) Notice: Subject to any disclaimer, the term of this patent is extended or adjusted under 35 U.S.C. 154(b) by 0 days.

(21) Appl. No.: 16/502,394

(22) Filed: Jul. 3, 2019

(65) Prior Publication Data

US 2019/0323225 A1 Oct. 24, 2019

Related U.S. Application Data

(63) Continuation-in-part of application No. 15/959,447, filed on Apr. 23, 2018.

(51) Int. Cl.

| | |
|---|---|
| ***E04B 1/00*** | (2006.01) |
| ***E04B 1/41*** | (2006.01) |
| ***A47K 3/40*** | (2006.01) |
| ***E04C 3/02*** | (2006.01) |
| *E04B 1/38* | (2006.01) |

(52) U.S. Cl.

CPC ..... *E04B 1/40* (2013.01); *A47K 3/405* (2013.01); *E04C 3/02* (2013.01); *E04B 2001/405* (2013.01)

(58) Field of Classification Search

CPC ... E04B 31/40; E04B 2001/405; A47K 3/405; A47K 3/40; A47K 1/04

See application file for complete search history.

(56) References Cited

U.S. PATENT DOCUMENTS

| | | | | |
|---|---|---|---|---|
| 3,995,404 | A * | 12/1976 | Thaw | E04G 23/0203 52/514 |
| 4,894,967 | A * | 1/1990 | Morton | E04B 7/00 228/182 |
| 5,653,079 | A * | 8/1997 | Loeffler | E04B 1/2608 403/396 |
| 6,209,277 | B1 * | 4/2001 | DiGate | E04F 13/0841 52/514 |
| 6,230,467 | B1 * | 5/2001 | Leek | E04B 1/2403 403/232.1 |
| 6,415,575 | B1 * | 7/2002 | Thompson | E04B 1/2608 52/712 |
| 6,560,943 | B1 * | 5/2003 | Leek | E04B 7/045 52/295 |
| 6,640,516 | B1 * | 11/2003 | Thompson | E04B 1/2608 52/712 |
| 7,254,919 | B2 * | 8/2007 | Lutz | E04B 7/045 52/699 |
| 7,559,519 | B1 * | 7/2009 | Dragic | E04B 2/7457 248/216.1 |

(Continued)

FOREIGN PATENT DOCUMENTS

| | | | | |
|---|---|---|---|---|
| GB | 2394757 | * | 8/2005 | E04B 5/12 |

*Primary Examiner* — Beth A Stephan

(74) *Attorney, Agent, or Firm* — Leyendecker & Lemire, LLC

(57) ABSTRACT

A set of differently configured brackets that when secured to one or more of the floor joists, wall edges and existing subfloor lower the subfloor a predetermined amount are described. The predetermined amount is typically sufficient to permit the installation of a shower pan of appropriate slope towards a drain and permit a curb-less transition between the surrounding floor and the shower stall floor.

19 Claims, 12 Drawing Sheets

(56) References Cited

U.S. PATENT DOCUMENTS

| | | | | |
|---|---|---|---|---|
| 7,617,648 | B2 * | 11/2009 | Moody | E04B 2/7457 52/481.1 |
| 8,677,718 | B2 * | 3/2014 | Marshall | E04D 3/3608 52/655.1 |
| 2018/0142463 | A1 * | 5/2018 | Siddhartha | E04B 1/40 |

* cited by examiner

SYSTEM AND METHOD FOR RECESSING A SUBFLOOR AND SHOWER STALL WITH A RECESSED SUBFLOOR FLOOR

CROSS-REFERENCE TO RELATED APPLICATION

This application is a continuation-in-part of U.S. application Ser. No. 15/959,447, filed Apr. 23, 2018.

BACKGROUND

Traditionally shower pans used in shower stalls are installed on top of a bathroom subfloor. As is typical, shower pans of all types, whether prefabricated or custom configured for a particular space, comprise a surface that is gently sloped towards a drain outlet. The need for a slope and the thickness of the materials comprising the shower pan have a distinct thickness that rises above flooring placed on a subfloor. Further, especially in the instance of a custom shower pan, finish flooring material is installed on top of the shower pan surface adding additional thickness.

Because of the added thickness of the shower pan over the surrounding bathroom floor, there usually must be a lip at the intersection of the pan with the surrounding floor to both provide for a visual transition for a shower user and to contain water from the shower in the stall. These lips can detract from the aesthetics of a shower stall, and even more significantly hinder access to and from the shower by the disabled and elderly.

While processes for recessing the subfloor of a bathroom in the region over which a shower pan is to be installed are known, they are usually very labor intensive, and accordingly expensive. Furthermore, if the recessed subfloor is not properly installed, which typically comprises wood bracing and blocking, the load carrying capacity of the recessed floor might not be adequate to handle the loads incident on it.

DETAILED DESCRIPTION

Figure 1:
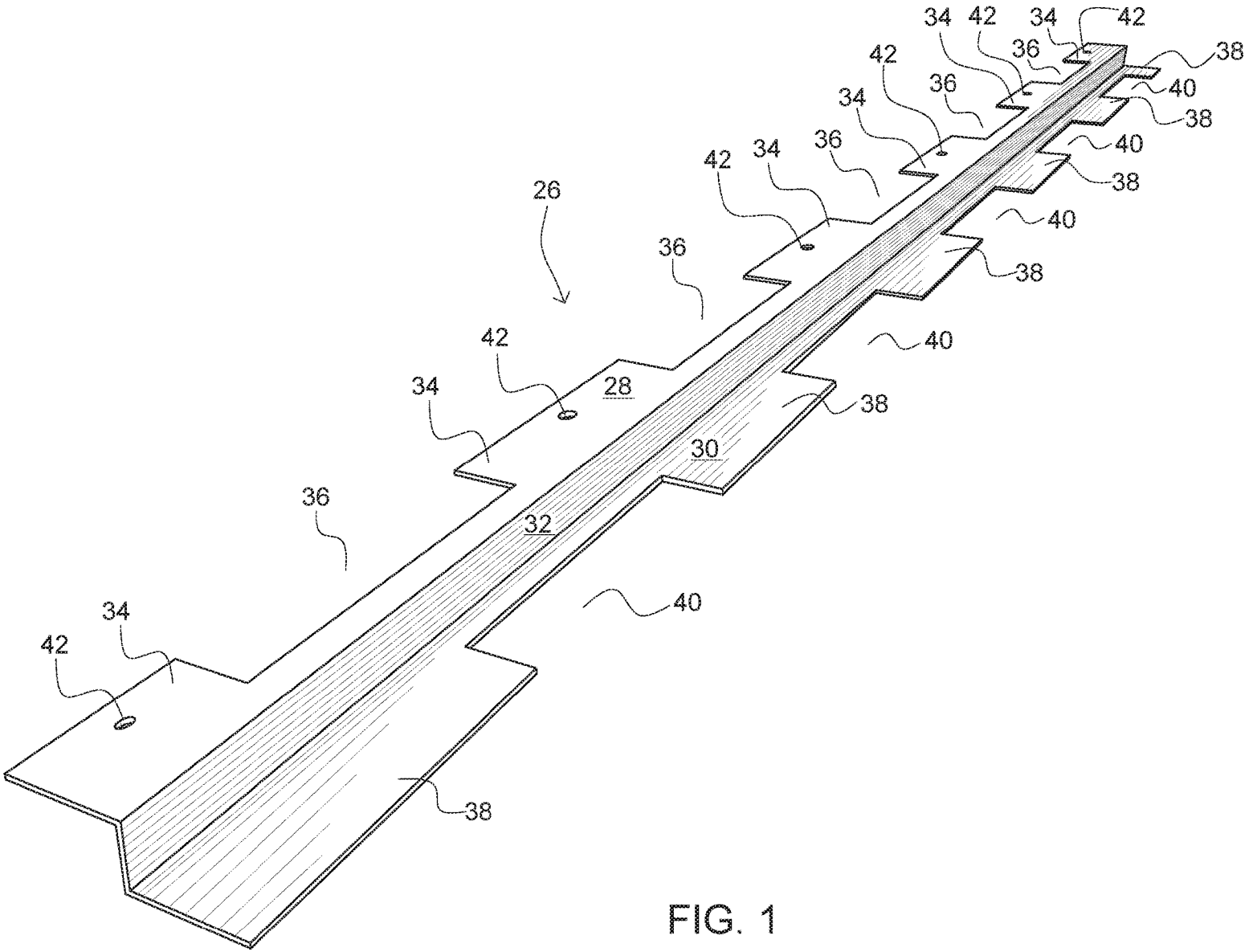
FIG. 1 is a perspective view of a main bracket used to attach a lowered subfloor to a floor joist according to one embodiment of the present invention.

Embodiments of the present invention include a set of differently configured brackets that when secured to one or more of floor joists, walls, and existing normal height subfloor, can lower a subfloor a predetermined amount. The predetermined amount can typically be sufficient to permit the installation of a shower pan of appropriate slope towards a drain and permit a curb-less transition between the surrounding floor and the shower stall floor. In one embodiment, the lowered subfloor can sit about 9/16" below a surrounding subfloor.

One embodiment of the system can include, but is not limited to, three different types of brackets: (i) a main bracket for attachment to a floor joist; (ii) an L-bracket for attachment to an adjacent wall; and (iii) a Z-bracket for attachment to the intersection with a surrounding normal height subfloor. The brackets are typically comprised of steel but can be made of aluminum or a fiber reinforced plastic in variations.

Another embodiment of the system can include, but is not limited to, two different types of brackets: (i) a joist bracket for attachment to a floor joist; and (ii) a three-tier bracket for attachment to an adjacent wall and/or for attachment to an intersection with a surrounding normal height subfloor. The brackets are typically comprised of steel but can be made of aluminum or a fiber reinforced plastic in variations.

In yet another embodiment, the system can include, but is not limited to, four different types of brackets: (i) a joist bracket for attachment to a floor joist; (ii) a modified joist bracket for attachment to a floor joist proximate an adjacent wall (iii) a three-tier bracket for attachment to an intersection with a surrounding normal height subfloor; and (iv) a modified three-tier bracket for attachment to the adjacent wall.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

A First Embodiment of a Set of Brackets for Recessing a Subfloor in a Room

Figure 2:
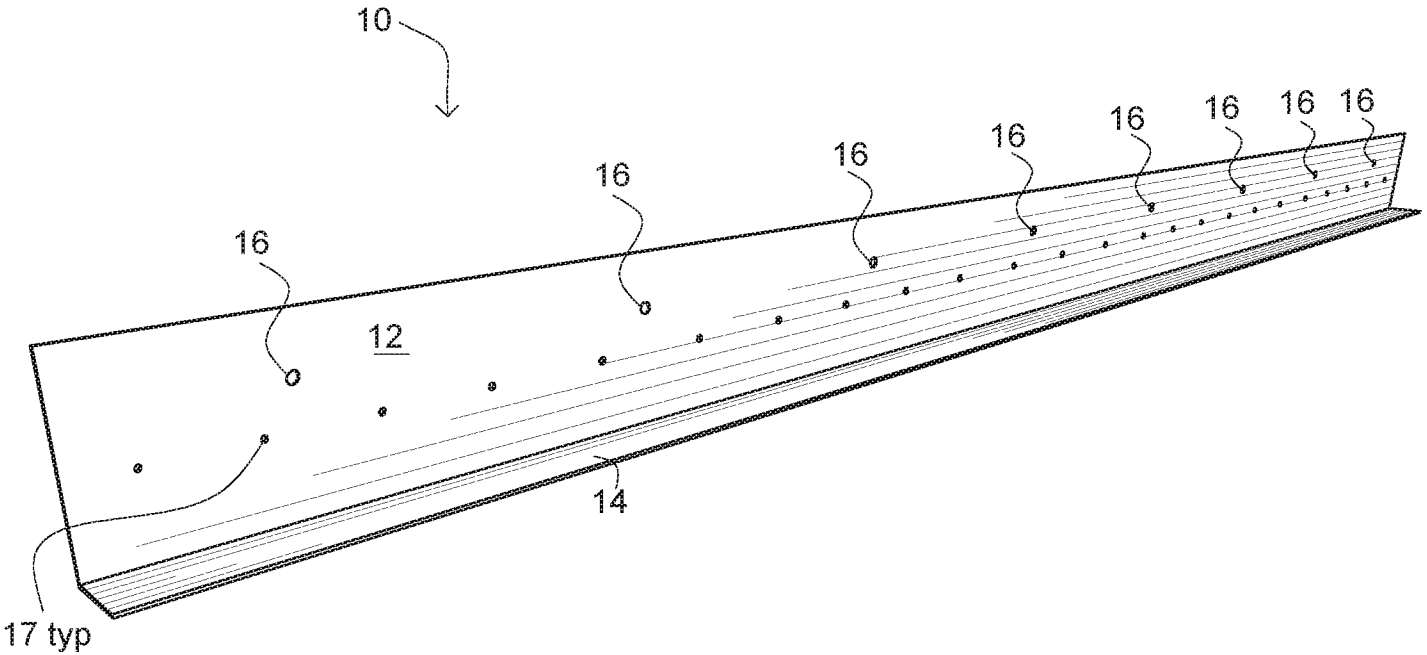
FIG. 2 is a perspective view of a L-bracket used to attach a lowered subfloor to a wall according to one embodiment of the present invention.
Figure 3:
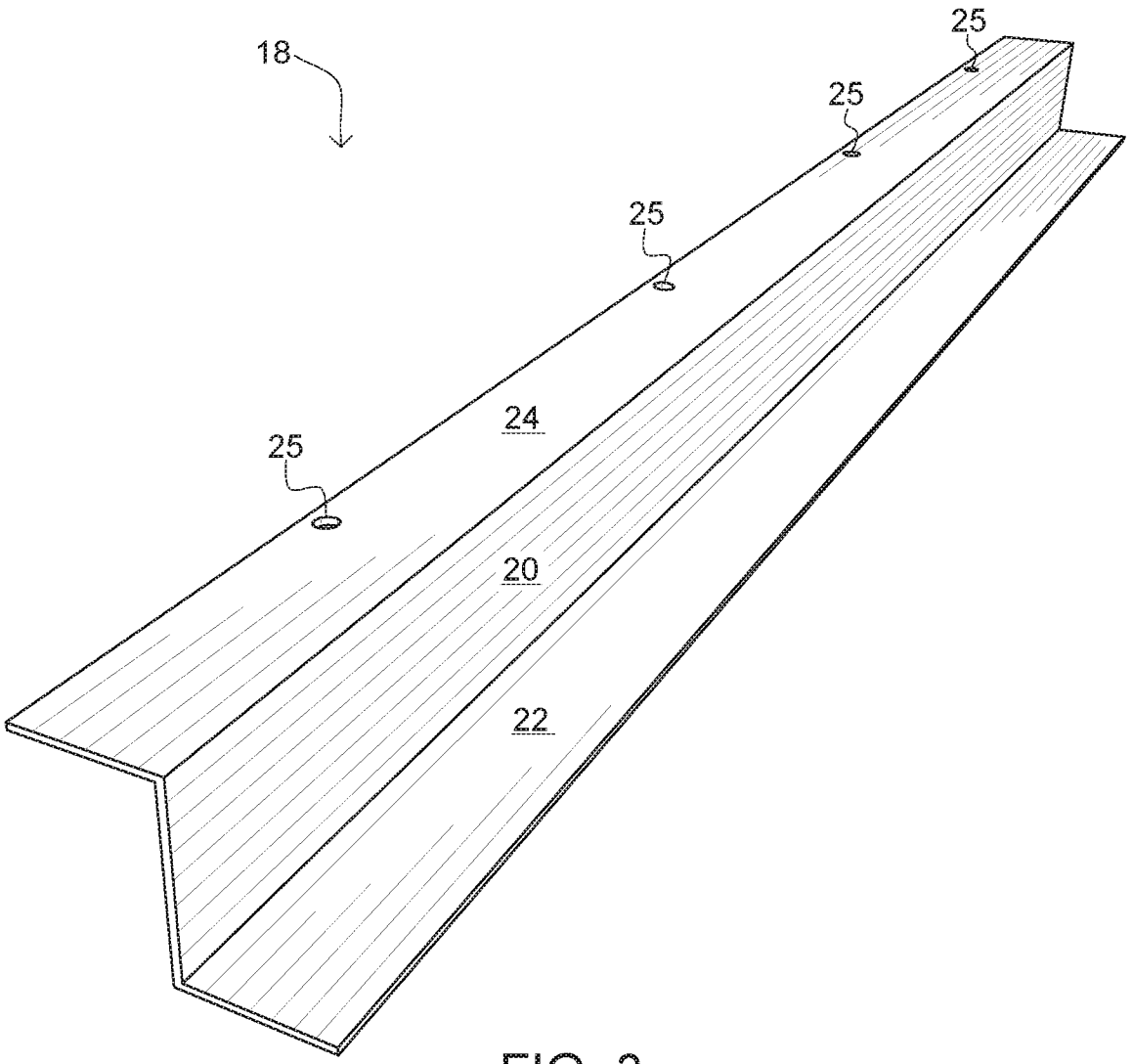
FIG. 3 is a perspective view of a Z-bracket used to attach a lowered subfloor to an adjoining normal height subfloor according to one embodiment of the present invention.

FIGS. 1-3 depict three types of brackets that can be implemented to install a recessed subfloor into a room also having a normal or standard height subfloor. Typically, subfloor sheathing usually comprising 23/32" thick oriented strand board (OSB) is installed on top of floor joists that are usually spaced 16" on center. By situating the subflooring sheets between floor joists instead of over them, the subfloor can be effectively lowered up to 23/32" while maintaining the top surfaces of the joists themselves level with or below the top surface of the subfloor sheathing.

By lowering the subfloor in a bathroom in the region of the room that will include a shower stall, a sloped shower pan (custom or prefabricated) can be installed over the lowered subfloor wherein the resulting edges of the shower pan are level or close to level with the adjacent normal height subfloor. This can allow for the uninterrupted installation of finish floor between the rest of the bathroom and the shower stall and permits the creation of a curbless transition therebetween.

Embodiments of the present system can include one or more types of brackets configured to lower the subfloor a predetermined distance. The one or more types of brackets can include, but are not limited to, an L-bracket 10 as shown in FIG. 2 designed for attachment to a shower wall, a Z-bracket 18 as shown in FIG. 3 for attachment to the top surface of a normal height subfloor sheet at an edge of the area where the subfloor is to be lowered, and a joist bracket 26 as shown in FIG. 1 for attachment to a floor joist in the area where the subfloor is to be lowered. In many, if not most instances, all three brackets can be utilized in conjunction with each other to lower a portion but not all of a subfloor in a room. It is to be appreciated that there are circumstances where only one or two of the bracket types can be implemented.

The brackets can be comprised of any suitable material although brackets comprised of thinner sheet or plate are preferred. Accordingly, the brackets are typically made with a material having relatively high strength and high stiffness permitting thinner planar sections are preferred. Most commonly, the brackets are made of 14-18 gauge steel or stainless-steel plate.

The dimensions of the brackets can vary, but embodiments of the set are configured so that when each is installed according to the described process the amount of subfloor drop offered by each relative to the top surface of a floor joist (or any other reasonable reference height) is the same for each bracket. For the specific embodiment(s) described herein, the dimensions given make the brackets suitable for use with standards for residential construction in the United States. As can be appreciated, the various dimensions can be easily adjusted for different construction materials and the standard dimensions of those materials in other embodiments. Pertinent standard dimensions of building materials that affect the dimensions of the illustrated embodiments include the 1½" thickness of a standard 2×4 framing stud and the 23/32" thickness of a standard sheet of OSB subfloor sheathing.

Figure 4:
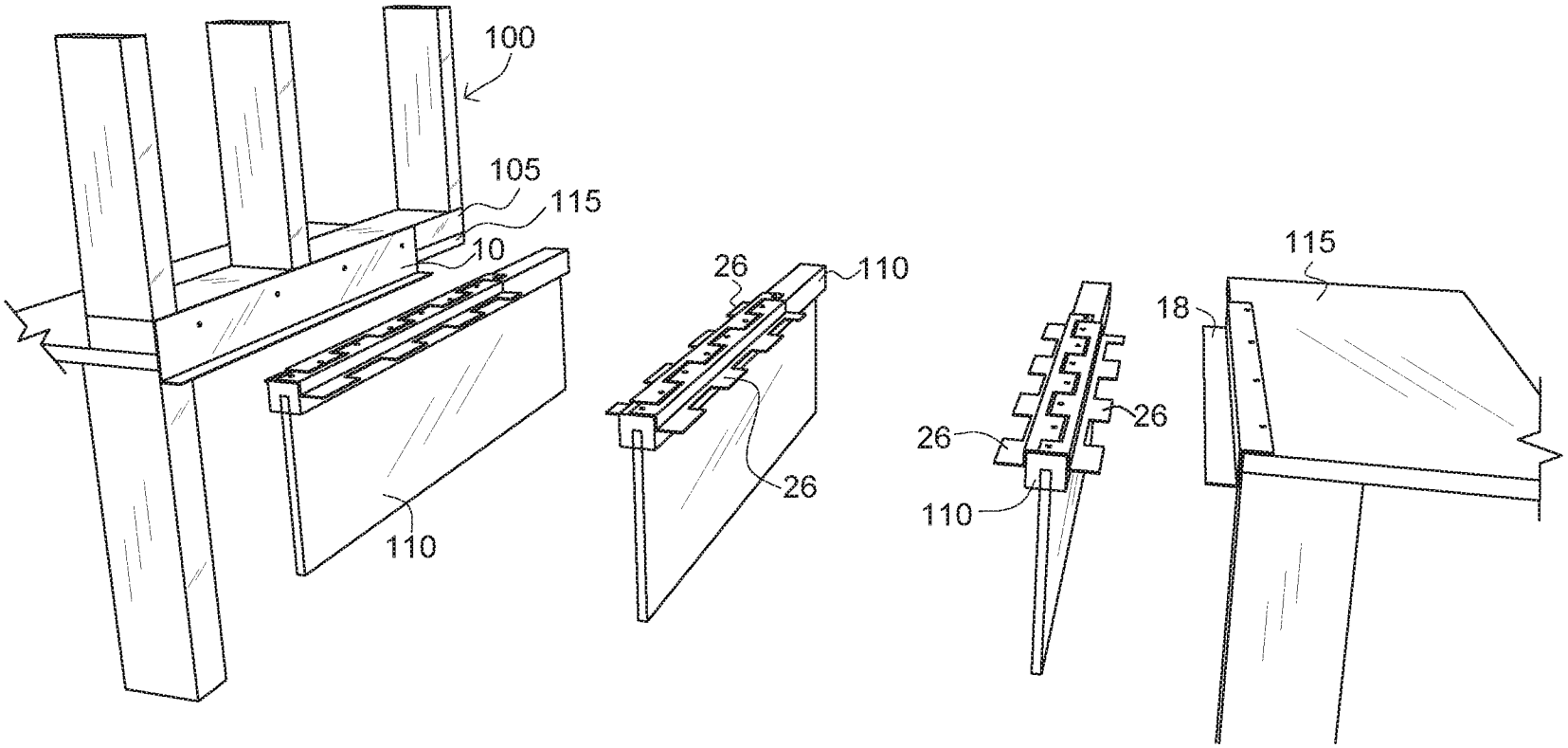
FIG. 4 is a perspective view showing the three types of brackets installed and ready to accept a recessed subflooring according to one embodiment of the present invention.

The L-bracket 10 is illustrated in perspective in FIG. 2 and shown installed in the proper position against a framedC wall 100 in FIG. 4. Significantly, the L-bracket comprises a substantially vertical leg 12 with a substantially horizontal flange 14 extending outwardly along a bottom edge of the vertical leg. A first series of horizontally aligned and evenly spaced bores 16 are provided along the length of the bracket to allow it to be secured to the sole plate of the wall framing typically with screws. Additional holes 17 can be provided in some embodiments below the spaced bores located at a position that permits small finish nails to be quickly and easily driven into the interface between the top surface of a normal height subfloor and the bottom surface of the 2×4 sole plate of the framed wall. These finish nails can help hold the bracket in place while the primary screws or nails are driven in the aforementioned bores 16.

Embodiments of the bracket can be provided in any desired length although about 46" is typical. As necessary, brackets can be butted up against each other for longer runs of the recessed subfloor along a wall. Further, longer lengths of bracket can be cut to fit in shorter wall runs. The width of the horizontal flange can vary although a depth of about one inch is typical. In certain embodiments, however, the height of the vertical leg critical in facilitating installation without requiring an installer to perform measurements and calculations to determine the specific placement of the bracket on the wall for a desired subfloor drop. Rather, by simply aligning the top edge of the vertical leg to be level with the top edge of the bottom horizontal 2×4 105 of a standard framed wall, the proper location of the horizontal flange is set.

In one embodiment, the length of the vertical leg from the top surface of the horizontal flange to the top edge of the leg is 2 about 45/64". Where the finished holes 17 are located 1 5/16" above the top surface of the horizontal flange and the finish nails are driven between the top of the flooring and the walls 2×4 header used, the horizontal flange will be located about 19/32" below the nominal top surface of the floor joists 110. As can be appreciated in real world construction, normal tolerances in both building materials and constructed walls and floors easily and regularly exceed 1/16 of an inch and as such dimensions measured to a 64th of an inch are somewhat theoretical and not representative of real-world conditions. Nevertheless, brackets made to accommodate standard dimensions ultimately reduce the amount of remedial work required to accommodate deviations in the other materials resulting from deviations from normal dimensions and tolerance stack.

The evenly spaced horizontally aligned bore holes 16 can be provided about 11/16" down from top edge of the bracket to facilitate the bracket being secured into the wall typically through the 2×4 stud.

The Z-bracket 18 used to attach a lowered subfloor to an adjoining normal height subfloor is shown in FIG. 3. Additionally, the bracket is shown installed on a normal height subfloor 115 in FIG. 4. This bracket is used along edges of the recessed floor area that interface with portions of the associated room that have a standard or normal height subfloor installed. For use in typical structures built to U.S. construction standards, the bracket can comprise 16 or 18 gauge steel sheet that has been bent or otherwise formed into the illustrated Z shape.

The bracket 18 has a substantially vertical leg 20 having top and bottom edges. A substantially horizontal bottom flange 22 extends outwardly from the bottom edge and a substantially horizontal upper flange 24 extends outwardly from the top edge in the opposing direction relative to the bottom flange. Evenly spaced bore holes 25 are provided along the length of the upper flange for use in securing the bracket to the top of a normal height subfloor.

In one embodiment, the bracket 18 is comprised of 16-gauge steel, which is about 1/16" thick. The height of the vertical wall is 1 3/8" from the top surface of the bottom flange to the top surface of the upper flange. This dimension will result in the top surface of the bottom flange being about 19/32" below the nominal top surface of the flooring joists 110.

The joist bracket 26 is illustrated in FIG. 1 and shown installed in FIG. 4. It is also Z-shaped with horizontal upper and lower flanges 28 & 30 extending from the top and bottom edges of the vertical leg 32. However, the height of the vertical leg, 21/32", is substantially less than that of the Z-bracket largely because the upper flange is received directly on a floor joist 110 instead of on top of a subfloor sheet mounted to a floor joist. For a bracket fabricated from 16-gauge steel, the top surface of the bottom flange is about 19/32" below the top surface of the floor joist when installed.

The upper flange of the joist bracket is characterized by a series of spaced tabs 34 separated by cutout sections 36 having at least a slightly greater length than the length of each tab. The lower flange is similarly configured comprising a series of alternating tabs 38 and cutout sections 40. Bore holes 42 for receiving fasteners are provided in the center of each upper flange tab for purposes of securing the bracket to the top surface of a floor joist. In another variation, additional bore holes 42 are provided through each upper flange tab giving an installer more options when attaching the upper flange to a joist permitting him/her to avoid any fasteners that may already have been driven into the joist.

With reference to FIG. 4, the purpose of the alternating tabs and cutouts of the upper flange can be understood. As shown, right and left (or first and second) joist brackets nest together on a single floor joist with the bottom flange of the left joist bracket extending outwardly to the left and the bottom flange of the right joist bracket extending outwardly to the right. By using tabs and corresponding cutouts each of the left and right joist brackets can be firmly secured to the floor joist with screws or nails proximate the longitudinal center of the joist for maximum purchase and strength. In typical embodiments, the joist brackets can be used on either the left or right side of a joist by simply rotating it 180 degrees.

In bathroom construction, it is sometimes desirable or necessary to double up floor joists or place floor joists mere inches apart instead of 16" apart. The tabs 38 and cutouts 40 on the lower flange allow face lower flanges of brackets mounted to adjacent but closely situated joists to intermesh.

In variations, a single joist bracket can be used with a c-shaped center portion that straddles the top of the joist and has both left and right bottom flanges the extend outwardly from the bottom edges of the c-shaped portion in opposite directions from each other. In another variation, the bottom flange may not include the tabs and cutouts and be similar to the bottom flange of the Z-bracket.

Figure 5A:
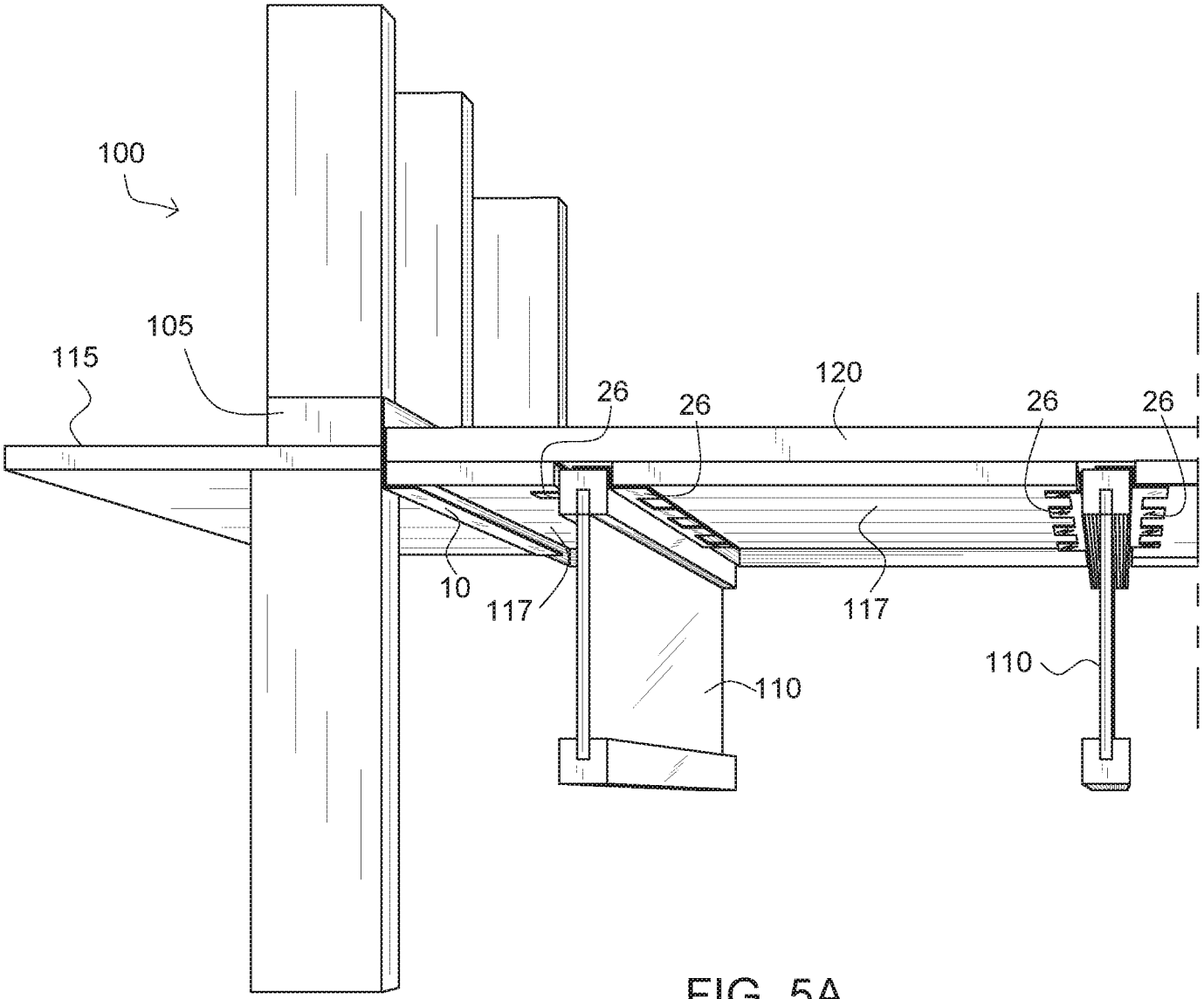
FIGS. 5A&B show a cross-sectional perspective view of a shower stall with a recessed subfloor according to one embodiment of the present invention.
Figure 5B:
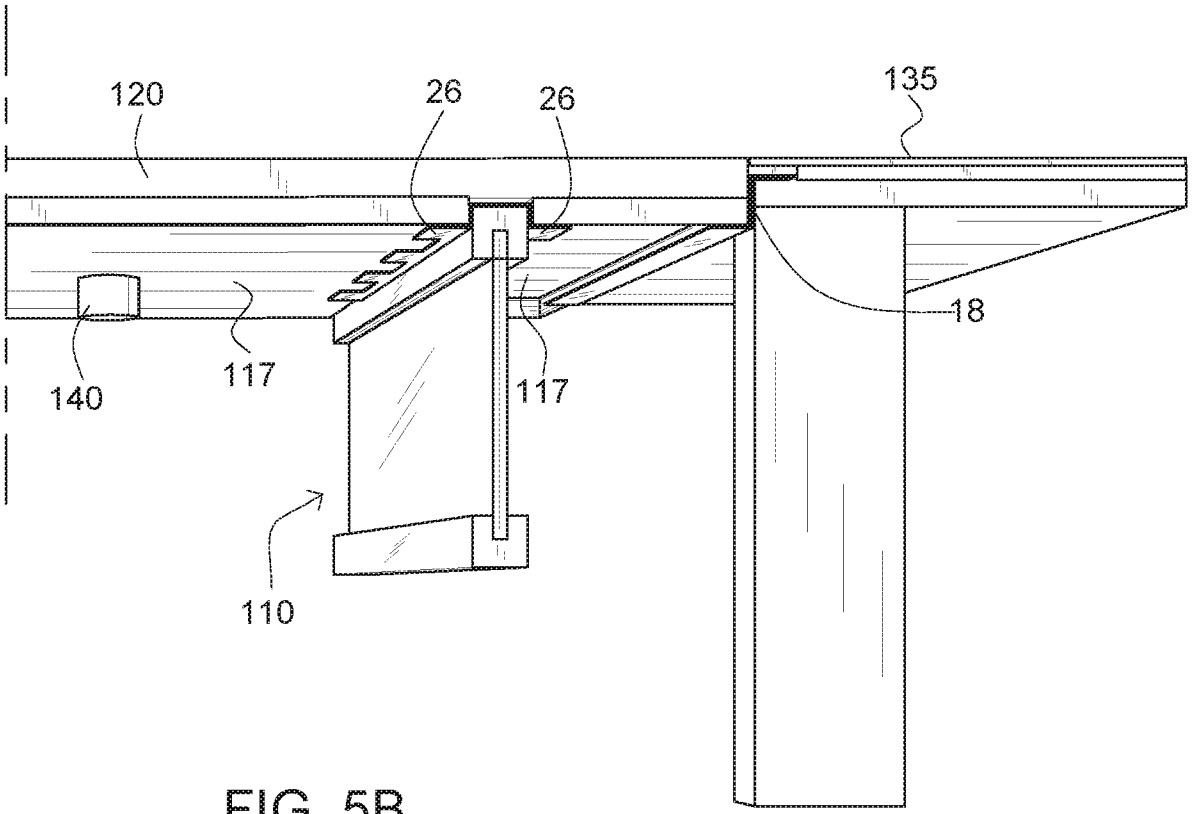

A side view/cross section of a curbless shower stall incorporating a recessed subfloor according to an embodiment of the present invention is illustrated in FIGS. 5A-5B. The stall comprises three floor joists 110 on which joist brackets 26 have been secured. One edge of the stall abuts a normal height subfloor 115 to which a Z-bracket 18 is secured. Another edge of the stall abuts a wall 100. The wall includes a sole plate 105 sitting on top of the normal height subfloor 115. An L-bracket 10 is attached to the wall. Sheets 117 of recessed subfloor are secured to the bottom flanges of the various brackets. A shower pan 120 (either prefabricated or custom fabricated) can rest on the recessed subfloor. As shown, the top edge of the shower pan is flush with the top surface of the finished floor 135 installed over the flooring normal height subfloor. As shown a drain 140 is installed in the shower stall floor. The drain can be any suitable type including a standard round drain or a linear drain.

In other variations, the shower pan can be thinner than the one illustrated in FIGS. 5A-5B wherein the top surface at the edges adjacent a normal height subfloor is flush with the normal height subfloor. Accordingly, the finish flooring can be installed across the interface between the stall and the rest of the bathroom uninterrupted and without a curb or lip.

A First Method of Installing a Recessed Subfloor Using an Embodiment of the Floor Brackets The bracket set described above can be utilized in both new construction and retrofitting existing construction. The example described herein pertains to the installation of a recessed subfloor for receiving a curbless shower stall installation thereon; however, the bracket set and associated methods can be used in any room in which at least a portion of the room's subfloor is to be recessed.

Initially, the area of a bathroom in which the shower stall is to be received is determined either before or after the installation of a normal height subfloor. Wherein a normal height subfloor has already been installed, it is removed in the region receiving the recessed subfloor. In installations where the normal height subfloor has not been installed, it is installed in all areas of the room excepting the area receiving the recessed subfloor. As necessary, any walls that will form the boundaries of the stall are framed.

Next, the various brackets from the set are installed. The order of installation is not typically critical and depending on manpower the different brackets can be installed contemporaneously. One or more L-brackets 10 are installed against the walls of the shower stall. The brackets can be provided in a standard length or lengths but where the standard length is too long the brackets can be cut to a desired size. Wherein the framed wall is attached directly to a normal height subfloor and comprises a 2×4, 2×6 or other 2× sole plate the installer need only align the top edge of the bracket's leg flush with the top surface of the sole plate to ensure the bottom flange will be located at the proper depth for the recessed subfloor. Alternatively, or additionally, the installer can drive small finish nails through the provided holes 17 and into the interface between the top of the normal height subfloor and the bottom of the sole plate. Provisionally securing the L-bracket to the walled edge this way will also set the bracket's lower flange at the proper depth. Once positioned, the bracket is screwed or nailed in place through the provided primary bore holes 16.

One or more Z-brackets 18 are installed along edges of the boundaries of the stall comprising normal height subfloor. The brackets can be provided in a standard length or lengths but where the standard length is too long the brackets can be cut to a desired size. The bracket(s) are positioned against and on the edge of the normal height subfloor and screwed or nailed into place through the provided bore holes.

The joist brackets 26 are identified as right or left brackets and cut to size as applicable. The brackets are usually pre-fit before being secured in place to ensure that the brackets properly nest and ensure that the brackets cover most if not substantially all of the length of the joists. Once positioned, the joist brackets are secured in place with nails or screws. Like with the L and Z brackets the bottom flanges of the joist brackets will be located at the proper depth to receive the recessed subfloor sheets.

Sheets of subflooring are cut to the proper width and length and placed onto the bottom flanges of the installed brackets. The subfloor sheeting can be secured to the flanges with adhesive or drilled and screwed in place as desired. Next, a prefabricated or custom shower pan of the appropriate thickness along its edges such that the surface of the pan adjacent the surface of the normal height subfloor is flush with the normal height subfloor or will be flush with finish flooring once it is installed over the normal height subfloor. As applicable, finish flooring, such as tile, can be installed over the shower pan and the normal height subfloor as necessary or desired spanning across the delineation between the normal height subfloor and the shower pan surface.

A Second Embodiment of a Set of Brackets for Recessing a Subfloor in a Room

Figure 6A:
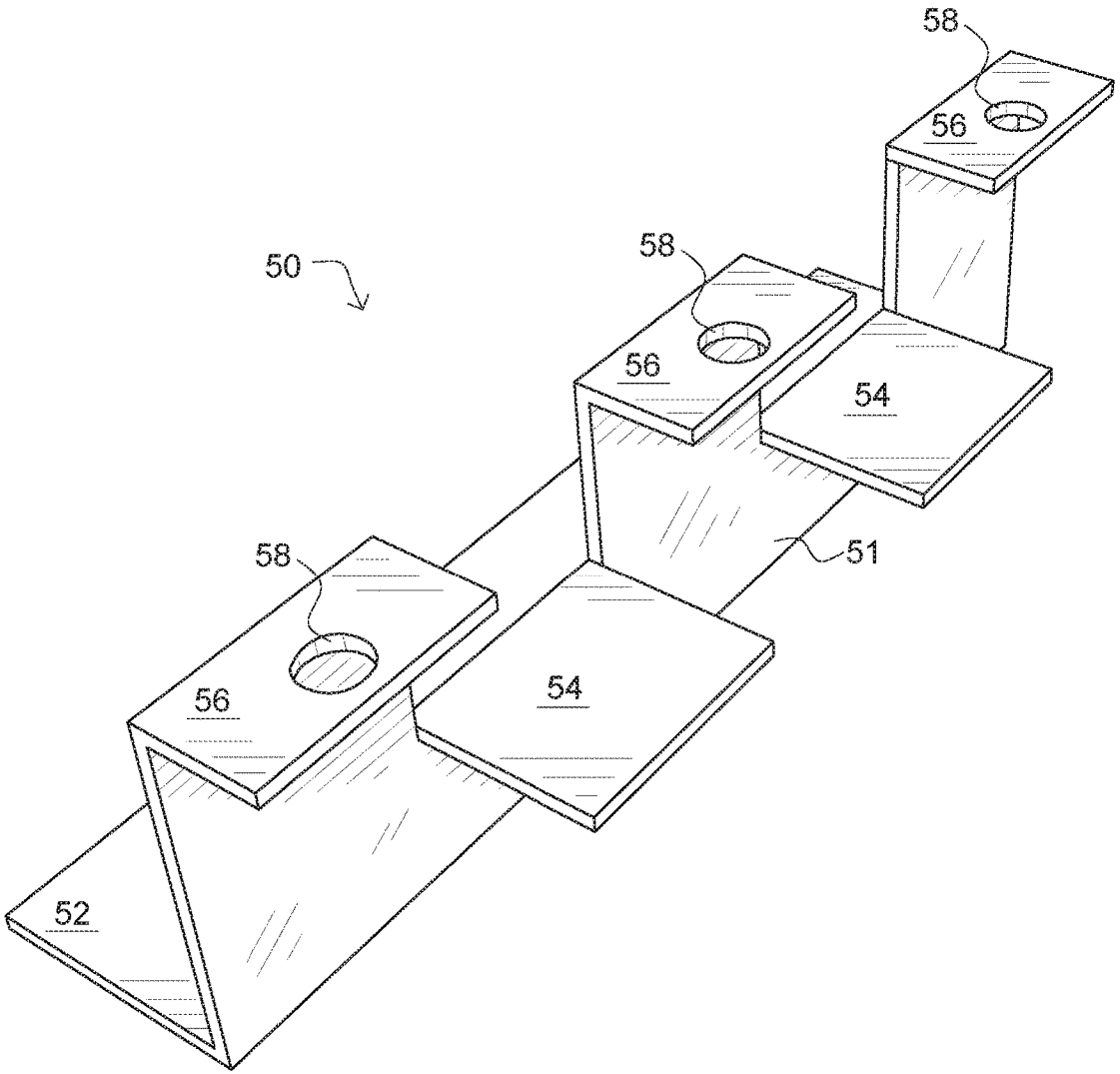
FIG. 6A is a back-perspective view of a three-tier bracket according to one embodiment of the present invention.
Figure 6B:
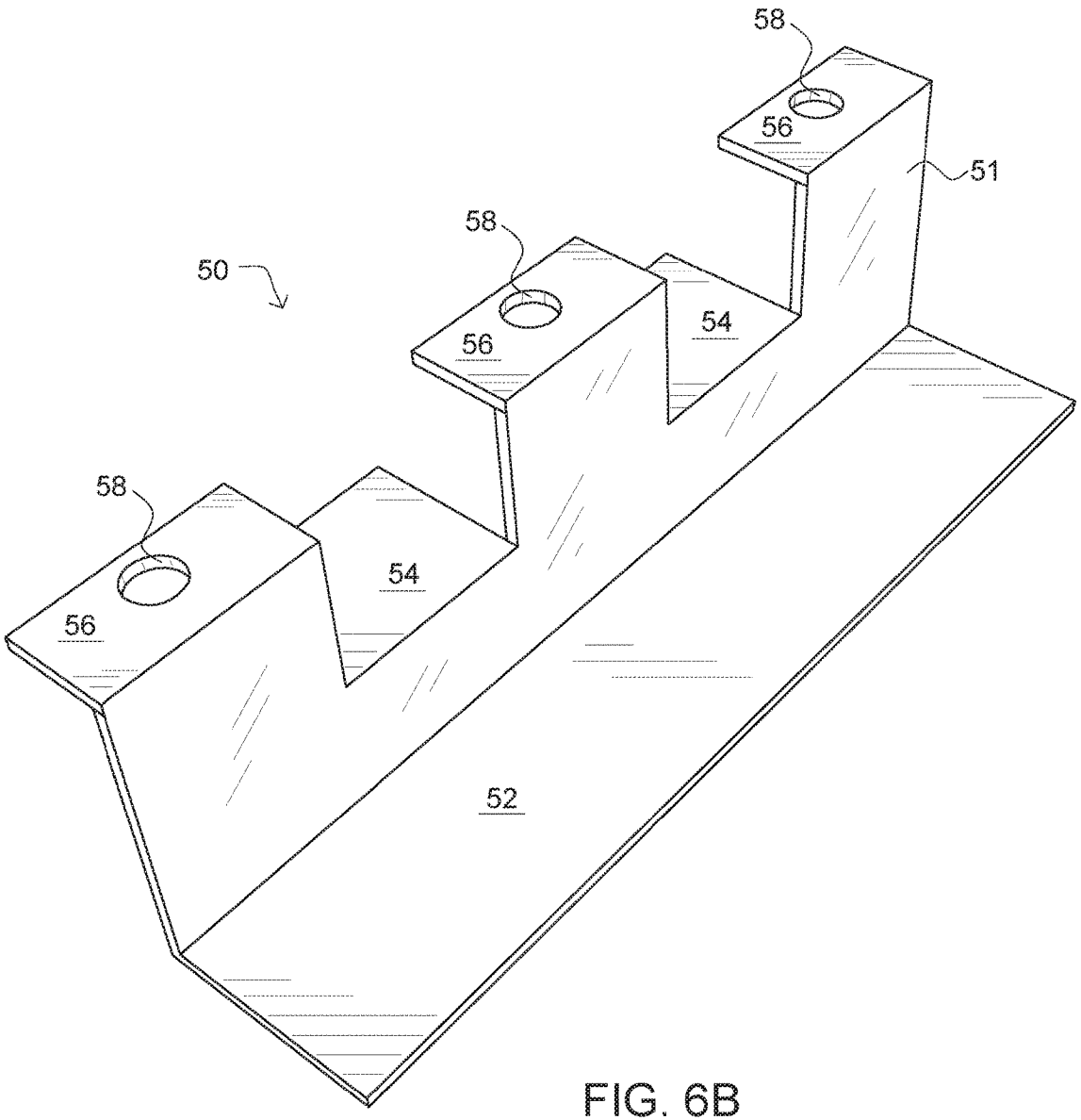
FIG. 6B is a front-perspective view of a three-tier bracket according to one embodiment of the present invention.

FIGS. 6A-6B depict a three-tier bracket 50 that can be implemented in combination with the previously discussed joist bracket 26 to install a recessed subfloor into a room also having a normal or standard height subfloor. The three-tier bracket 50 can be used in place of the previously described L-bracket 10 and Z-bracket 18.

As shown, the three-tier bracket 50 can have a substantially vertical planar leg 51 having top, middle, and bottom edges. A substantially horizontal lower flange 52 can extend outwardly from the bottom edge of the vertical leg 51. A substantially horizontal middle flange 54 can extend outwardly from the middle edge of the vertical leg 51 in an opposing direction from the substantially horizontal lower flange 52. In one embodiment, the middle flange 54 can be defined by a plurality of evenly spaced outwardly extending tabs further defining a plurality of cutouts between the tabs. A substantially horizontal upper flange 56 can extend outwardly from the top edge of the vertical leg 51 in the same direction as the substantially horizontal middle flange 54. In one embodiment, the upper flange 56 can be defined by a plurality of evenly spaced outwardly extending tabs further defining a plurality of cutouts between the tabs. Evenly spaced boreholes 58 can be provided on each of the tabs of the upper flange 56 for use in securing the three-tier bracket 50 to a top of a normal height subfloor. Of note, although the upper flange 56 and the middle flange 54 are shown as tabs with cutouts, it is to be appreciated that a singular flange similar to the lower flange 52 may be implemented for each of the flanges 54, 56.

In one embodiment, the bracket 50 can be comprised of 16-gauge steel, which is about 1/16" thick. The height of the vertical leg 51 can be approximately 1 7/16" inches from the top surface of the lower flange 52 to the top surface of the upper flanges 56. The distance between a top surface of the middle flanges 54 and a bottom surface of the upper flanges 56 can be approximately 23/32". A width and a length of the lower flange 52 can be approximately 1" by 5". A width and a length of the middle flanges 54 and the upper flanges 56 can be approximately 1" by 1". The boreholes 58 can have an approximately 1/4" diameter with a center of the borehole being located 1/2" by 3/16" from an outer edge of the upper flanges 56.

Figure 7A:
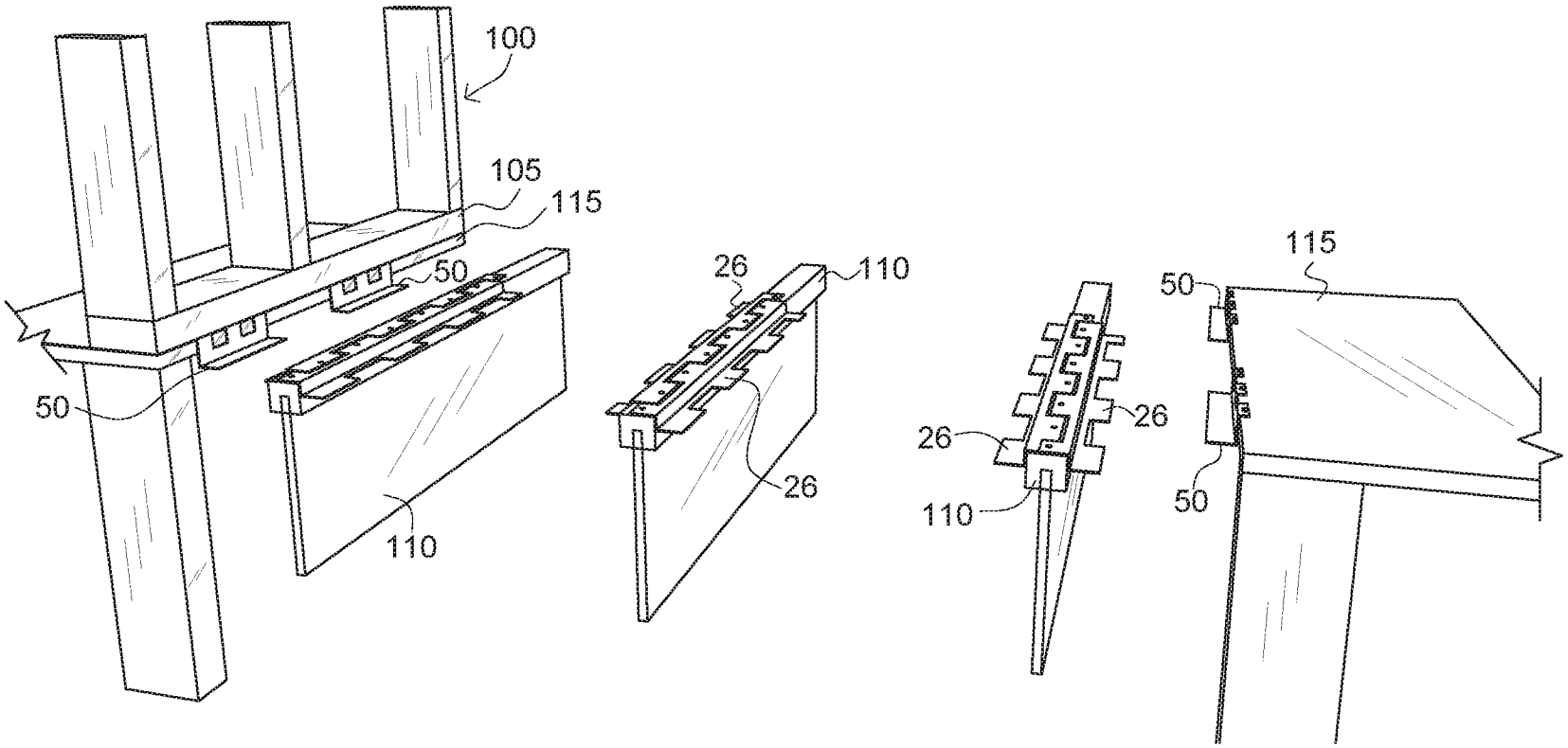
FIG. 7A is a perspective view showing two types of brackets installed and ready to accept a recessed subflooring according to one embodiment of the present invention.

As previously mentioned, the three-tier bracket 50 can be implemented in place of the previously described L-bracket 10 and Z-bracket 18, as shown in FIG. 7A.

Figure 7B:
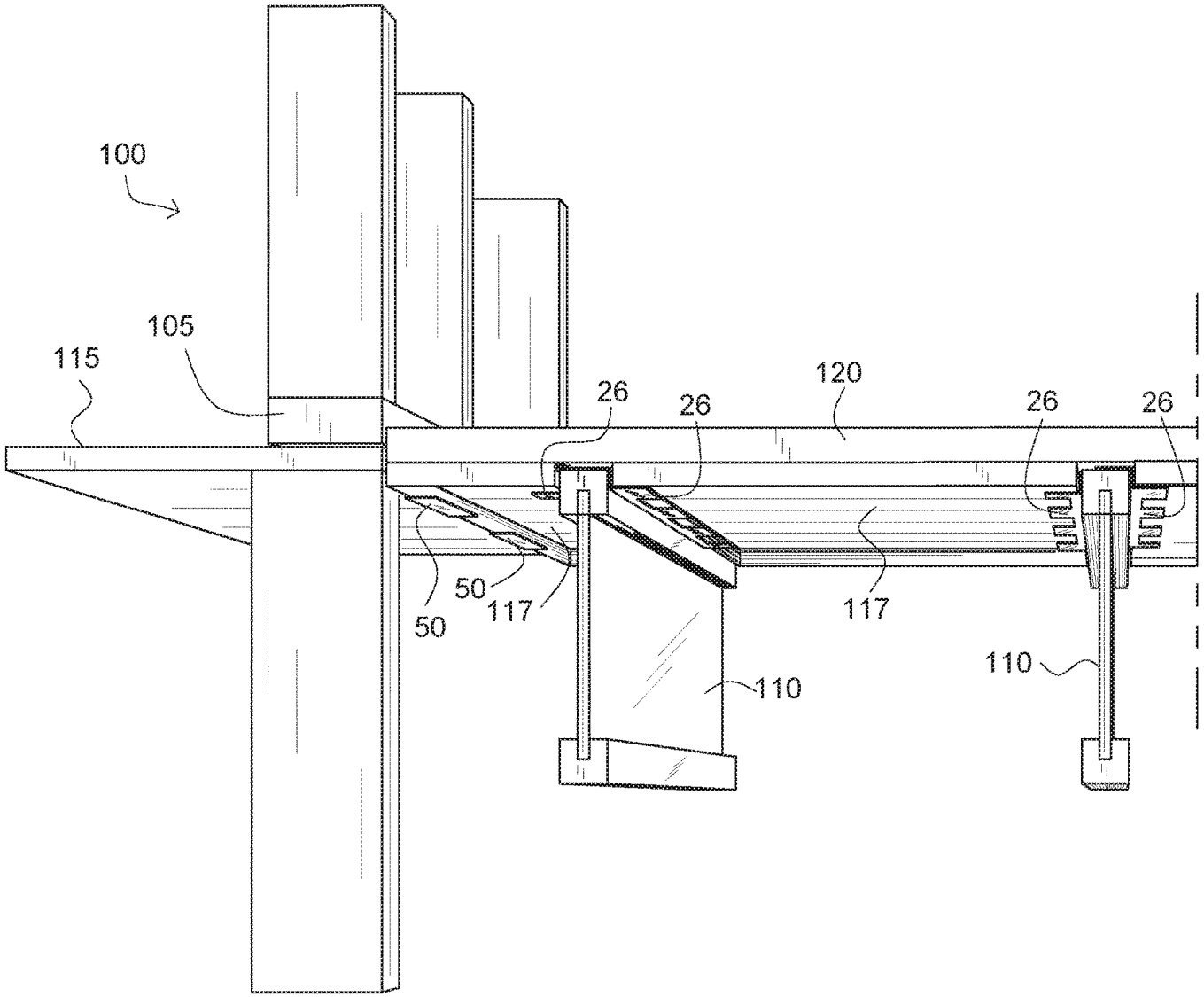
FIGS. 7B-7C show cross-sectional perspective views of a shower stall with a recessed subfloor according to one embodiment of the present invention.

Similar to the L-bracket 10, the three-tier bracket 50 can be installed in a proper position against a framed wall 100, as shown in FIGS. 7A-7B. The upper flange 56 of the bracket 50 can be driven between the top surface of a normal height subfloor 115 and a bottom surface of the 2×4 sole plate 105 of the framed wall securing the three-tier bracket 50 to the framed wall 100.

Figure 7C:
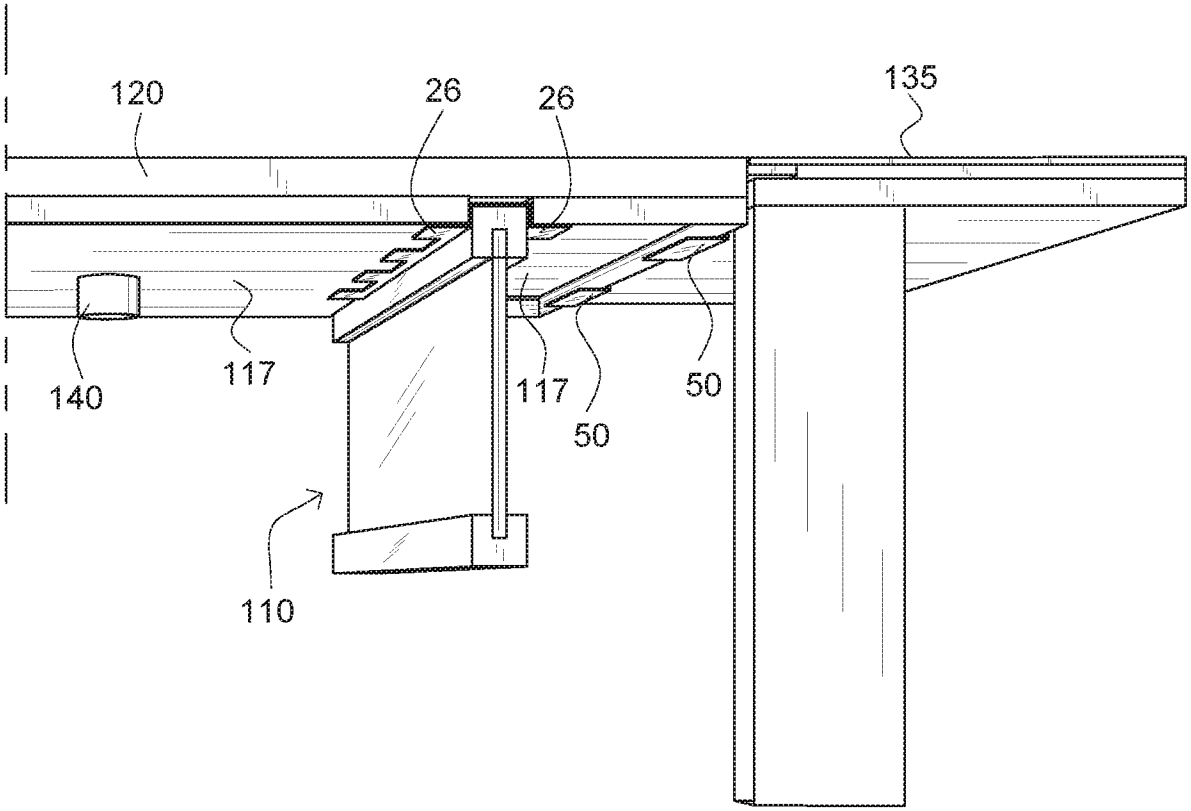

Similar to the Z-bracket 18, the three-tier bracket 50 can be used to attach a lowered subfloor 117 to an adjoining normal height subfloor 115 as shown in FIGS. 7A and 7C. Additionally, the bracket 50 is shown installed on a normal height subfloor 115 in FIG. 7A. The bracket 50 can be used along edges of the recessed floor area that interface with portions of the associated room that have a standard or normal height subfloor installed. For use in typical structures built to U.S. construction standards, the bracket 50 can comprise 16 or 18 gauge steel sheet that has been bent or otherwise formed into the illustrated three-tier shape.

A Second Method of Installing a Recessed Subfloor Using an Embodiment of the Floor Brackets The combination of brackets described above can be utilized in both new construction and retrofitting existing construction. The example described herein pertains to the installation of a recessed subfloor for receiving a curbless shower stall installation thereon; however, the bracket set and associated methods can be used in any room in which at least a portion of the room's subfloor is to be recessed.

Initially, the area of a bathroom in which the shower stall is to be received is determined either before or after the installation of a normal height subfloor. Wherein a normal height subfloor has already been installed, it is removed in the region receiving the recessed subfloor. In installations where the normal height subfloor has not been installed, it is installed in all areas of the room excepting the area receiving the recessed subfloor. As necessary, any walls that will form the boundaries of the stall are framed.

Next, the various brackets from the set can be installed. The order of installation is not typically critical and depending on manpower the different brackets can be installed contemporaneously. One or more three-tier brackets 50 can be installed against the walls of the shower stall. The brackets 50 can be provided in a standard length or lengths, but where the standard length is too long, the brackets can be cut to a desired size. Wherein the framed wall is attached directly to a normal height subfloor and comprises a 2×4, 2×6 or other 2× sole plate, the installer need only insert the top flange 56 of the bracket 50 between the normal height subfloor and the sole plate. When inserted, the lower flange 52 of the bracket 50 can be located at the proper depth for the recessed subfloor. Alternatively, or additionally, the installer can drive small finish nails through the interface between the top of the normal height subfloor and the bottom of the sole plate.

One or more three-tier brackets 50 can then be installed along edges of the boundaries of the stall comprising normal height subfloor. The bracket(s) 50 can be positioned against and on the edge of the normal height subfloor and screwed or nailed into place through the provided bore holes 58 on the upper flange 56 of the three-tier bracket(s) 50.

The joist brackets 26 are identified as right or left brackets and cut to size as applicable. The brackets are usually pre-fit before being secured in place to ensure that the brackets properly nest and ensure that the brackets cover most if not substantially all of the length of the joists. Once positioned, the joist brackets are secured in place with nails or screws. Like with the three-tier bracket, the bottom flanges of the joist brackets 26 can be located at the proper depth to receive the recessed subfloor sheets.

Sheets of subflooring can be cut to the proper width and length and placed onto the bottom flanges of the installed brackets. The subfloor sheeting can be secured to the flanges with adhesive or drilled and screwed in place as desired. Next, a prefabricated or custom shower pan of the appropriate thickness along its edges such that the surface of the pan adjacent the surface of the normal height subfloor is flush with the normal height subfloor or will be flush with finish flooring once it is installed over the normal height subfloor. As applicable, finish flooring, such as tile, can be installed over the shower pan and the normal height subfloor as necessary or desired spanning across the delineation between the normal height subfloor and the shower pan surface.

A Third Embodiment of a Set of Brackets for Recessing a Subfloor in a Room

Figure 8:
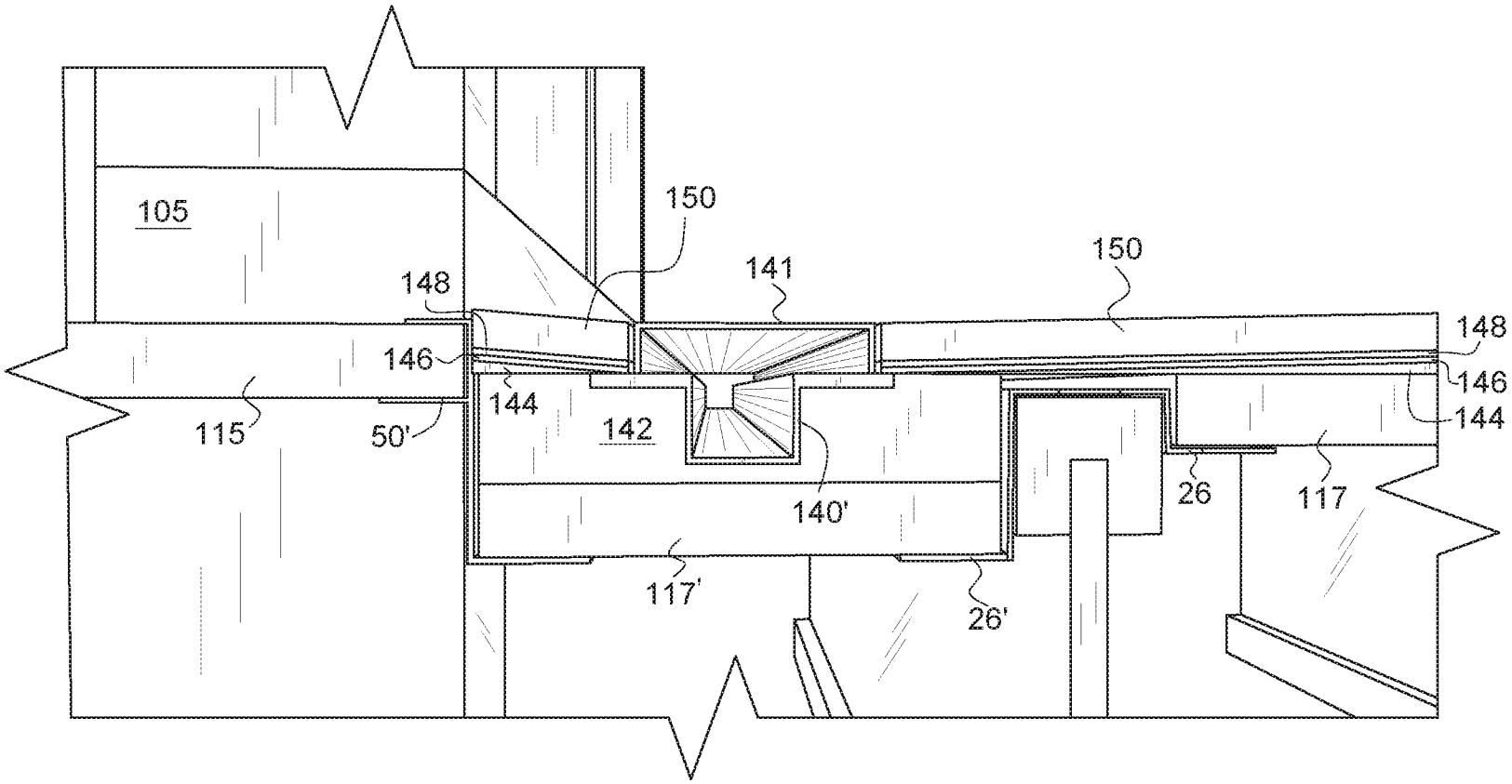
FIG. 8 is a cross-sectional perspective view of a shower stall with a recessed linear drain and subfloor according to one embodiment of the present invention.

FIG. 8 depicts a linear drain body 140' installed with modified brackets to allow a top of the linear drain body 140' to be approximately level with a top of a recessed subfloor in a room. One or more modified three-tier brackets 50' and one or more modified joist brackets 26' can be implemented to help install a section of a recessed subfloor 117' below the other sections of the subfloor 117.

The modified three-tier bracket 50' can have a vertical leg with a height of approximately 2 and 7/16" inches from a top surface of a lower flange of the bracket 50' to a top surface of an upper flange of the bracket 50'. A vertical leg of the modified joist bracket 26' can have a height of approximately 1 and 21/32".

The modified joist brackets 26' can be configured to nest together with the previously described joist brackets 26. Typically, the brackets 26, 26' can nest on a single floor joist with the bottom flange of a left joist bracket extending outwardly to the left and the bottom flange of a right joist bracket extending outwardly to the right. By using tabs and corresponding cutouts each of the left and right joist brackets can be firmly secured to the floor joist with screws or nails proximate the longitudinal center of the joist for maximum purchase and strength. In typical embodiments, the modified joist brackets 26' and the joist brackets 26 can be used on either the left or right side of a joist by simply rotating it 180 degrees.

Typically, the linear drain body 140' can be secured in place by a filler 142. The filler 142 can include, but is not limited to, foam, backer board, concrete, etc. The linear drain body 140' can include a linear drain cover 141. A slope 144 (e.g., mortar, cardboard, pre-made slope) can be implemented to direct water down towards the linear drain body 140'. A waterproofing membrane 146 can be implemented to help ensure that no water leaks into the subfloor. As shown, a layer of mortar 148 (e.g., thinset) can be implemented to secure tile 150 in place on top of the waterproofing membrane 146. As can be appreciated, the tile 150 can be sloped down towards the linear drain body 140'.

A Third Method of Installing a Recessed Subfloor Using an Embodiment of the Floor Brackets The combination of brackets described above can be utilized in both new construction and retrofitting existing construction. The example described herein pertains to the installation of a recessed subfloor for receiving a linear drain assembly installation thereon; however, the bracket set and associated methods can be used in any room in which at least a portion of the room's subfloor is to be recessed.

Initially, the area of a bathroom in which the shower stall is to be received is determined either before or after the installation of a normal height subfloor. Wherein a normal height subfloor has already been installed, it is removed in the region receiving the recessed subfloor. In installations where the normal height subfloor has not been installed, it is installed in all areas of the room excepting the area receiving the recessed subfloor. As necessary, any walls that will form the boundaries of the stall are framed.

Next, the various brackets from the set can be installed. The order of installation is not typically critical and depending on manpower the different brackets can be installed contemporaneously. One or more modified three-tier brackets 50' can be installed against the walls of the shower stall. The brackets can be provided in a standard length or lengths, but where the standard length is too long, the brackets can be cut to a desired size. Wherein the framed wall is attached directly to a normal height subfloor and comprises a 2×4, 2×6 or other 2× sole plate, the installer need only insert the top flange of the bracket 50' between the normal height subfloor and the sole plate. Of note, by using the modified three-tier brackets 50', the lower flange of the bracket 50' can be recessed 1" lower than a three-tier bracket 50. When inserted, the lower flange of the bracket 50' will be located at the proper depth for the recessed subfloor 117'. Alternatively, or additionally, the installer can drive small finish nails through the interface between the top of the normal height subfloor and the bottom of the sole plate.

One or more three-tier brackets 50 can be installed along edges of the boundaries of the stall comprising normal height subfloor. The bracket(s) can be positioned against and on the edge of the normal height subfloor and screwed or nailed into place through the provided bore holes 58 on the upper flange 56 of the three-tier bracket(s) 50.

The joist brackets 26 are identified as right or left brackets and cut to size as applicable. The brackets are usually pre-fit before being secured in place to ensure that the brackets properly nest and ensure that the brackets cover most if not substantially all of the length of the joists. Once positioned, the joist brackets are secured in place with nails or screws. Like with the three-tier bracket, the bottom flanges of the joist brackets 26 can be located at the proper depth to receive the recessed subfloor sheets.

One or more modified joist bracket 26' can be installed on a joist located proximate the shower stall wall. As can be appreciated, the bottom flange of the modified joist bracket 26' can be substantially on level with the lower flange of the modified three-tier bracket 50'. The subflooring 117' can be installed between the shower stall wall and the joist located proximate the wall. Of note, this subflooring can be located lower than the other subflooring, as shown in FIG. 8, on top of the lower flanges of the modified three-tier brackets 50' and the bottom flanges of the modified joist brackets 26'.

Sheets of subflooring can be cut to the proper width and length and placed onto the bottom flanges of the installed brackets. The subfloor sheeting can be secured to the flanges with adhesive or drilled and screwed in place as desired. Next, a prefabricated or custom shower pan of the appropriate thickness along its edges such that the surface of the pan adjacent the surface of the normal height subfloor is flush with the normal height subfloor or will be flush with finish flooring once it is installed over the normal height subfloor. As applicable, finish flooring, such as tile, can be installed over the shower pan and the normal height subfloor as necessary or desired spanning across the delineation between the normal height subfloor and the shower pan surface.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

It is to be appreciated that the specific dimensions provided herein are done so by way of example. Variations of the brackets can be designed and fabricated to recess the subfloor any desired dimension for any desired purpose.

I claim:

1. A combination of brackets for recessing a portion of a subfloor in a room a predetermined amount relative to subflooring attached to a top surface of floor joists spanning across the room, the combination of brackets comprising at least:

a three-tier bracket having a substantially vertical planar leg extending (i) upwardly from an intersection along a bottom edge with a substantially horizontal lower flange, (ii) downwardly from an intersection along a middle edge with a plurality of substantially horizontal planar middle flanges, and (iii) downwardly from an intersection along an upper edge with a plurality of substantially horizontal planar upper flanges; and elongated first and second joist brackets, each joist bracket being Z-shaped and comprising a substantially vertical planar joist bracket leg extending (i) upwardly from an intersection along a bottom edge with a substantially horizontal planar joist bracket bottom flange, and (ii) downwardly from an intersection along a top edge with a substantially horizontal planar joist bracket upper flange;

wherein (i) the three-tier bracket planar leg has a first height; (ii) the three-tier bracket middle flanges and the three-tier bracket upper flanges each comprise evenly spaced outwardly extending tabs further defining a plurality of cutouts between the tabs; (iii) the substantially vertical planar joist bracket leg has a second height; (iv) the joist bracket upper flange comprises a plurality of evenly spaced outwardly extending tabs further defining a plurality of cutouts between the tabs; and (v) the tabs of the first joist bracket are configured to nest in the cutouts of the second joist bracket and the tabs of the second joist bracket are configured to nest in the cutouts of the first joist bracket when installed on opposing sides of a floor joist.

2. The combination of claim 1, wherein the first and second heights are each different from each other.

3. The combination of claim 1, wherein the outwardly extending tabs of the middle flanges of the three-tier bracket correspond with the plurality of cutouts between the tabs of the upper flanges of the three-tier bracket.

4. The combination of claim 1, wherein the three-tier bracket upper flanges and the three-tier bracket middle flanges extend away from the three-tier bracket vertical leg in an opposite direction of the three-tier bracket lower flange.

5. The combination of claim 1, wherein the outwardly extending tabs of the upper flanges of the three-tier bracket each include at least one tab bore extending therethrough.

6. The combination of claim 1, wherein each of the three-tier bracket and the joist brackets are comprised of plate steel.

7. The combination of claim 1, wherein the tabs of the first and second joist brackets each include at least one tab bore extending therethrough.

8. The combination of claim 1, the combination of brackets further including:

at least one modified three-tier bracket, the modified three-tier bracket having a height that is approximately 1" more than a height of the three-tier bracket; and at least one modified elongated joist bracket, the modified elongated joist bracket having a height that is approximately 1" more than a height of the elongated first joist bracket.

9. A shower stall including (a) the combination of claim 1, (b) at least one floor joist, (c) at least one shower stall wall, (d) at least one edge abutting a normal height subfloor, and (e) a floor;

wherein (i) the three-tier bracket is secured to the at least one shower stall wall, (ii) a second three-tier bracket is secured to the normal height subfloor at the at least one edge, and (iii) the first and second joist brackets are secured to the at least one floor joist.

10. The floor of a shower stall of claim 9, wherein top surfaces of the lower flanges of the three-tier brackets and the bottom flanges of the joist brackets are about planar with each other.

11. The floor of the shower stall of claim 10, further comprising:

one or more sheets of shower stall subflooring, the one or more sheets of shower stall subflooring installed over the lower flanges of the three-tier brackets and the bottom flanges of the joist brackets;

wherein top surfaces of the one or more sheets of shower stall subflooring are about even with top surfaces of the upper flanges of the three-tier brackets and the joist brackets.

12. The floor of the shower stall of claim 11, further including a shower pan, the shower pan being installed over the one or more sheets of shower stall subflooring.

13. The floor of the shower stall of claim 12, wherein a perimeter edge of the shower pan located adjacent a normal height subfloor of a surrounding bathroom is even in height with the normal height subfloor.

14. The floor of the shower stall of claim 12, wherein a perimeter edge of the shower pan located adjacent a normal height subfloor of a surrounding bathroom is even in height with finish flooring installed on top of the normal height subfloor.

15. A method of installing the combination of claim 1 in a bathroom to facilitate the creation of a shower stall having a recessed subfloor, the method comprising:

installing the three-tier bracket to a shower stall wall by inserting the upper flange of the first three-tier bracket between a sole plate and a normal height subfloor such that the normal height subfloor is embraced by the upper flange and middle flange of the first three-tier bracket;

installing a second three-tier bracket by securing an upper flange of the second three-tier bracket to a normal height subfloor bounding an edge of the shower stall; and installing the first and second joist brackets on the same floor joist by nesting the tabs of each in the cutouts of the other and securing the joist bracket upper flanges to a top surface of the floor joist.

16. The method of claim 15, further comprising:

installing sheets of subflooring over opposing flanges of the three-tier bracket lower flanges and the joist bracket bottom flanges.

17. The method of claim 16, further comprising:

installing a shower pan over the recessed subfloor; and installing finish flooring over the shower pan.

18. A combination of brackets for recessing a portion of a subfloor in a room a predetermined amount relative to subflooring attached to a top surface of floor joists spanning across the room, the combination of brackets being made of steel and comprising:

a three-tier bracket having a substantially vertical planar leg extending (i) upwardly from an intersection along a bottom edge with a substantially horizontal lower flange, (ii) downwardly from an intersection along a middle edge with a plurality of substantially horizontal planar middle flanges, and (iii) downwardly from an intersection along an upper edge with a plurality of substantially horizontal planar upper flanges;

first, second, and third elongated joist brackets, each of the joist brackets being Z-shaped and comprising a substantially planar joist bracket vertical leg extending (i) upwardly from an intersection along a bottom edge with a substantially horizontal planar joist bracket bottom flange, and (ii) downwardly from an intersection along a top edge with a substantially horizontal planar joist bracket upper flange;

a modified three-tier bracket having a substantially vertical planar leg extending (i) upwardly from an intersection along a bottom edge with a substantially horizontal lower flange, (ii) downwardly from an intersection along a middle edge with a plurality of substantially horizontal planar middle flanges, and (iii) downwardly from an intersection along an upper edge with a plurality of substantially horizontal planar upper flanges; and a modified joist bracket, the joist bracket being Z-shaped and comprising a substantially planar joist bracket vertical leg extending (i) upwardly from an intersection along a bottom edge with a substantially horizontal planar joist bracket bottom flange, and (ii) downwardly from an intersection along a top edge with a substantially horizontal planar joist bracket upper flange;

wherein (i) the vertical planar leg of the modified three-tier bracket is approximately one inch longer than the vertical planar leg of the three-tier bracket; (ii) the vertical leg of the modified joist bracket is approximately one inch longer than the vertical leg of the first, second, and third joist brackets; (iii) the three-tier bracket middle flanges and the three-tier bracket upper flanges each comprise evenly spaced outwardly extending tabs further defining a plurality of cutouts between the tabs, and (iv) the joist bracket upper flanges each comprise a plurality of evenly spaced outwardly extending tabs further defining a plurality of cutouts between the tabs.

19. A method of installing the combination of claim 18 in a bathroom to facilitate the creation of a shower stall having a recessed subfloor, the method comprising:

installing the modified three-tier bracket to a shower stall wall by inserting the upper flanges of the modified three-tier bracket between a sole plate and a normal height subfloor such that the normal height subfloor is embraced by the upper flanges and middle flanges of the modified three-tier bracket;

installing the three-tier bracket by securing the upper flanges of the three-tier bracket to a normal height subfloor bounding the edge of the shower stall;

installing the first and second joist brackets on a floor joist by nesting the tabs of each in the cutouts of the other and securing the joist bracket upper flanges to a top surface of the floor joist; and installing the modified joist bracket opposite the third joist bracket on a floor joist proximate the shower stall wall by nesting the tabs of each in the cutouts of the other and securing the joist bracket upper flanges to a top surface of the floor joist.

* * * * *